US009927147B2

(12) United States Patent
Wu et al.

(10) Patent No.: US 9,927,147 B2
(45) Date of Patent: Mar. 27, 2018

(54) PTC ELECTRIC HEATING ASSEMBLY, ELECTRIC HEATING DEVICE AND ELECTRIC VEHICLE

(71) Applicant: BYD COMPANY LIMITED, Shenzhen (CN)

(72) Inventors: Mengxiang Wu, Shenzhen (CN); Maolin Ren, Shenzhen (CN); Tianyou Deng, Shenzhen (CN); Shumin Wang, Shenzhen (CN); Xiaofang Li, Shenzhen (CN); Hongmei Qiu, Shenzhen (CN); Xinping Lin, Shenzhen (CN)

(73) Assignee: BYD COMPANY LIMITED, Pingshan (CN)

( * ) Notice: Subject to any disclaimer, the term of this patent is extended or adjusted under 35 U.S.C. 154(b) by 562 days.

(21) Appl. No.: 14/405,498

(22) PCT Filed: Jun. 27, 2013

(86) PCT No.: PCT/CN2013/078184

§ 371 (c)(1),
(2) Date: Dec. 4, 2014

(87) PCT Pub. No.: WO2014/000665

PCT Pub. Date: Jan. 3, 2014

(65) Prior Publication Data

US 2015/0168014 A1 Jun. 18, 2015

(30) Foreign Application Priority Data

Jun. 27, 2012 (CN) ..... 2012 1 0215331

(51) Int. Cl.
*F24H 3/06* (2006.01)
*F24H 3/10* (2006.01)
(Continued)

(52) U.S. Cl.
CPC ..... *F24H 9/1872* (2013.01); *F24H 1/009* (2013.01); *F24H 1/121* (2013.01); *F24H 3/002* (2013.01);
(Continued)

(58) Field of Classification Search
None
See application file for complete search history.

(56) References Cited

U.S. PATENT DOCUMENTS 1,529,200 A * 3/1925 Mercer ..... F24H 1/102 219/523
4,223,208 A * 9/1980 Kleinschmidt ..... H05B 3/141 219/439
(Continued)

FOREIGN PATENT DOCUMENTS

CN 2074523 U 4/1991
CN 2612898 Y 4/2004
(Continued)

OTHER PUBLICATIONS

CN 101715255 A, May 2010, Zhang, partial translation.*
International Search Report for PCT/CN2013/078184 dated Oct. 10, 2013.

*Primary Examiner* — Joseph M Pelham

(57) ABSTRACT

A PTC electric heating assembly, an electric heating device and an electric vehicle are provided. The PTC electric heating assembly (2) comprises two electrode plates (23) and a PTC heating module (20) disposed between the two electrode plates (23), and comprising an insulation fixing frame (22) and a plurality of PTC heating elements (21), the insulation fixing frame (22) defining a plurality of fixing units (220) and the PTC heating elements (21) being disposed into the fixing units (220) respectively.

14 Claims, 6 Drawing Sheets

(51) Int. Cl.

| | |
|---|---|
| ***F24H 9/18*** | (2006.01) |
| ***H05B 3/14*** | (2006.01) |
| ***H05B 3/30*** | (2006.01) |
| ***H05B 3/24*** | (2006.01) |
| ***F24H 1/00*** | (2006.01) |
| ***F24H 1/12*** | (2006.01) |
| ***F24H 3/08*** | (2006.01) |
| ***F24H 3/00*** | (2006.01) |
| *F24H 3/04* | (2006.01) |

(52) U.S. Cl.
CPC ..... *F24H 3/082* (2013.01); *F24H 9/1827* (2013.01); *H05B 3/141* (2013.01); *H05B 3/24* (2013.01); *F24H 3/0429* (2013.01); *H05B 2203/02* (2013.01); *H05B 2203/023* (2013.01)

(56) References Cited

U.S. PATENT DOCUMENTS

| | | | | | |
|---|---|---|---|---|---|
| 5,028,763 | A * | 7/1991 | Chung-Tai | H05B 3/30 | 219/505 |
| 5,064,997 | A | 11/1991 | Fang et al. | | |
| 5,125,070 | A * | 6/1992 | Chung-Tai | H05B 3/30 | 219/505 |
| 5,889,260 | A * | 3/1999 | Golan | H05B 3/14 | 219/504 |
| 8,183,505 | B2 * | 5/2012 | Niederer | F24H 3/0405 | 219/520 |
| 8,946,599 | B2 * | 2/2015 | Niederer | B60H 1/2221 | 219/205 |
| 2009/0026194 | A1 * | 1/2009 | Bohlender | F24H 3/0405 | 219/532 |
| 2010/0055481 | A1 | 3/2010 | Kubo et al. | | |
| 2013/0161307 | A1 * | 6/2013 | Bohlender | H05B 3/02 | 219/202 |
| 2014/0124499 | A1 | 5/2014 | Wei et al. | | |
| 2016/0360572 | A1 * | 12/2016 | Bohlender | H05B 1/0236 | |

FOREIGN PATENT DOCUMENTS

| | | | |
|---|---|---|---|
| CN | 1897767 | A | 1/2007 |
| CN | 1937859 | A | 3/2007 |
| CN | 101097092 | A | 1/2008 |
| CN | 201119017 | Y | 9/2008 |
| CN | 201146614 | Y | 11/2008 |
| CN | 101715255 | A * | 5/2010 |
| CN | 201690621 | U | 12/2010 |
| EP | 072078 | A1 | 2/1986 |
| EP | 1182908 | A1 | 2/2002 |
| EP | 1921896 | A1 | 5/2008 |
| JP | H097738 | A | 1/1997 |
| JP | 10162940 | | 6/1998 |
| JP | 2001110552 | A | 4/2001 |
| KR | 20060067635 | A | 6/2006 |

* cited by examiner

PTC ELECTRIC HEATING ASSEMBLY, ELECTRIC HEATING DEVICE AND ELECTRIC VEHICLE

CROSS-REFERENCE

This application is a National Stage Application of, and claims priority to, PCT Application No. PCT/CN2013/078184, filed Jun. 27, 2013, entitled "PTC ELECTRIC HEATING ASSEMBLY, ELECTRIC HEATING DEVICE AND ELECTRIC VEHICLE" which claims priority to Chinese Patent Application No. 201210215331.8, filed with State Intellectual Property Office, P. R. C. on Jun. 27, 2012. Both the PCT application and the Chinese application are incorporated herein by reference in their entireties.

FIELD OF THE INVENTION

The present disclosure relates to a PTC electric heating assembly, an electric heating device having the PTC electric heating assembly and an electric vehicle having the electric heating device.

BACKGROUND ART

Air-conditioning and heating system of a conventional fuel vehicle generally use the waste heat of flue gas or circulating cooling water of the engine as a heating source. However, for a hybrid electric vehicle or a pure electric vehicle, there is no sufficient waste heat for heating of the interior the vehicle. Furthermore, under a condition of extremely low temperature, the heat source is also used to defrost and defog. Thus, an auxiliary electric heating device is needed.

Therefore, an electric heating device using a PTC (Positive Temperature Coefficient) heating assembly is proposed. The electric heating device has a casing and at least one PTC heating assembly disposed inside the casing. The conventional PCT heating assembly includes two electrical insulation plates, a PTC heating element arranged between the two electrical insulation plates and two contact plates (electrode plates). The PCT heater is fixedly clamped by the two contact plates. As the PTC heating assembly includes a plurality of the PTC heating elements, the plurality of the PTC heating elements are difficultly fixed due to different thicknesses or improper arranging positions of the PTC heating elements. Furthermore, because the PTC heating element is very sensitive to the temperature and the heating effects of the plurality of the PTC heating elements are not identical, the plurality of the PTC heating elements may contact each other during heating, thus causing that the plurality of the PTC heating elements can not give full play to their heating performance. In addition, when used in the electric vehicle, the PTC heating element subjects to a high voltage, so that a distance between the two electrode plates is increased in order to avoid arc discharge occurred between the two electrode plates, thus causing the volume and the occupied space of the PTC heating element large.

SUMMARY

Embodiments of the present disclosure seek to solve at least one of the problems existing in the prior art to at least some extent.

According to embodiments of a first broad aspect of the present disclosure, there is provided a PTC electric heating assembly comprising two electrode plates; and a PTC heating module disposed between the two electrode plates, and including an insulation fixing frame defining a plurality of fixing units, a plurality of PTC heating elements disposed in the fixing units respectively.

According to embodiments of a second broad aspect of the present disclosure, there is provided an electric heating device, comprising a casing defining a plurality of thermal conducting grooves and a medium circulating cavity hermetically isolated from the thermal conducting grooves, the medium circulating cavity defining a medium inlet and a medium outlet; and a plurality of PTC electric heating assemblies mounted into the thermal conducting grooves respectively, the PTC electric heating assembly is according to the first aspect of the present disclosure.

According to embodiments of a third broad aspect of the present disclosure, there is provided an electric vehicle, employing an air conditioning system, the air conditioning system includes the electric heating device according to the second aspect of the present disclosure.

With the PTC electric heating assembly and the electric heating device according to embodiments of the present disclosure, the PTC heating elements are fixed within the fixing unit of the insulation fixing frame respectively, so that the PTC heating elements are stably positioned and isolated from each other by the insulation fixing frame, thus avoiding contacting of the PTC heating elements, reducing the interference among the PTC heating elements during the operation, giving full play to the heating performance thereof, improving the heating power thereof and increasing the heating effect of the electric heating device.

BRIEF DESCRIPTION OF EACH FIGURE OF THE DRAWING

DETAILED DESCRIPTION

Figure 1:
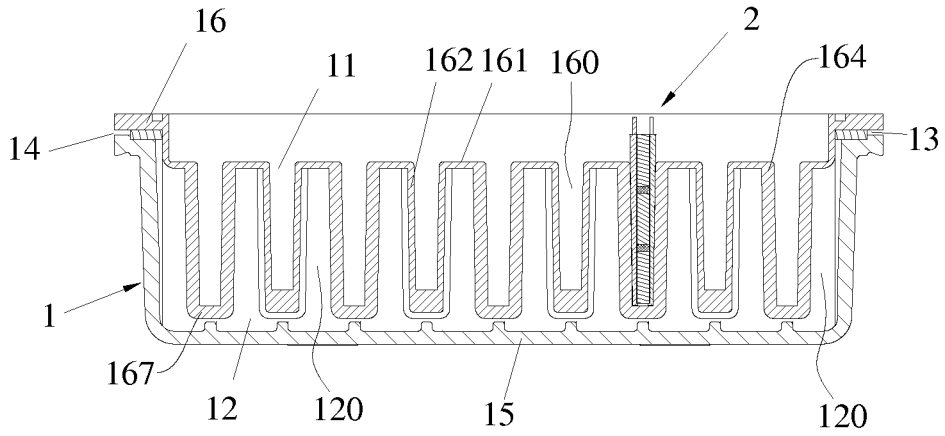
FIG. 1 is a sectional view of an electric heating device according to an embodiment of the present disclosure.

The embodiments described herein with reference to drawings are explanatory, illustrative, and used to generally understand the present disclosure.

In the specification, Unless specified or limited otherwise, relative terms such as "central", "longitudinal", "lateral", "front", "rear", "right", "left", "inner", "outer", "lower", "upper", "horizontal", "vertical", "above", "below", "up", "top", "bottom" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance. Thus, characteristics defined by the terms "first" and "second" may indicatively or impliedly comprise one or plurality of the characteristics. In the description of the present disclosure, term "plurality of" means two or more than two, unless there is another certain definition.

Unless specified or limited otherwise, the terms "mounted," "connected," "supported," and "coupled" and variations thereof are used broadly and encompass both direct and indirect mountings, connections, supports, and couplings.

A PTC electric heating assembly 2 according to an embodiment of the present disclosure will be described below with reference to the drawings. For example, an electric heating device having the PTC electric heating assembly 2 may be used in an electric vehicle, however, the present disclosure is not limited thereto.

As shown in FIGS. 2-7, the PTC electric heating assembly 2 according to embodiments of the present disclosure comprises a PTC heating module 20 and two electrode plates 23 disposed at two sides (left and right sides in FIG. 2) of the PTC heating module. In other words, each electrode plate 23 has two side surfaces opposite to each other (left side surface and right surface in FIG. 2). The two electrode plates 23 are spaced apart from each other and the left side surface of one electrode plate 23 is opposite to the right side surface of the other electrode plate 23. The PTC heating module 20 is disposed between the side surfaces opposite to each other of the two electrode plates 23.

As shown in FIGS. 4-7, the PTC heating module 20 comprises an insulation fixing frame 22 and a plurality of PTC heating elements 21. The insulation fixing frame 23 has a plurality of fixing units 220 such as fixing grooves or fixing space, and the plurality of fixing units 220 are spaced apart from one another. The PTC heating elements 21 are disposed in the fixing units 220 in a one-to-one correspondence relationship, so that the PTC heating elements 21 are isolated from each other. In other words, the insulation fixing frame 23 is used to fix the plurality of the PTC heating elements 21 therein and isolate the adjacent PTC heating elements 21 from each other. Thus, the PTC heating elements 21 can be fixed stably, the interference with each other during operation can be reduced, and the PTC heating elements 21 can give full play to the heating performance thereof.

Figure 4:
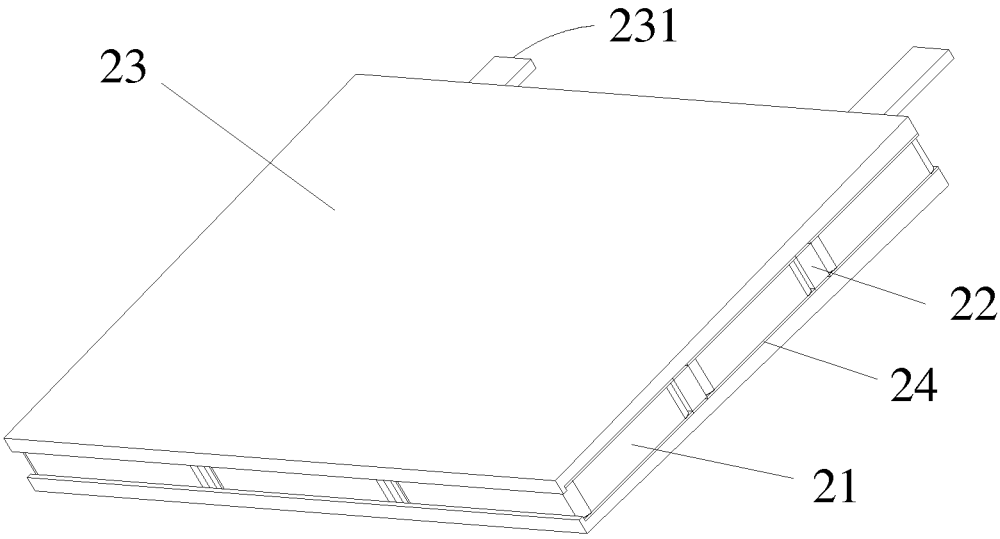
FIG. 4 is a schematic view of the PTC electric heating assembly according to an embodiment of the present disclosure.
Figure 5:
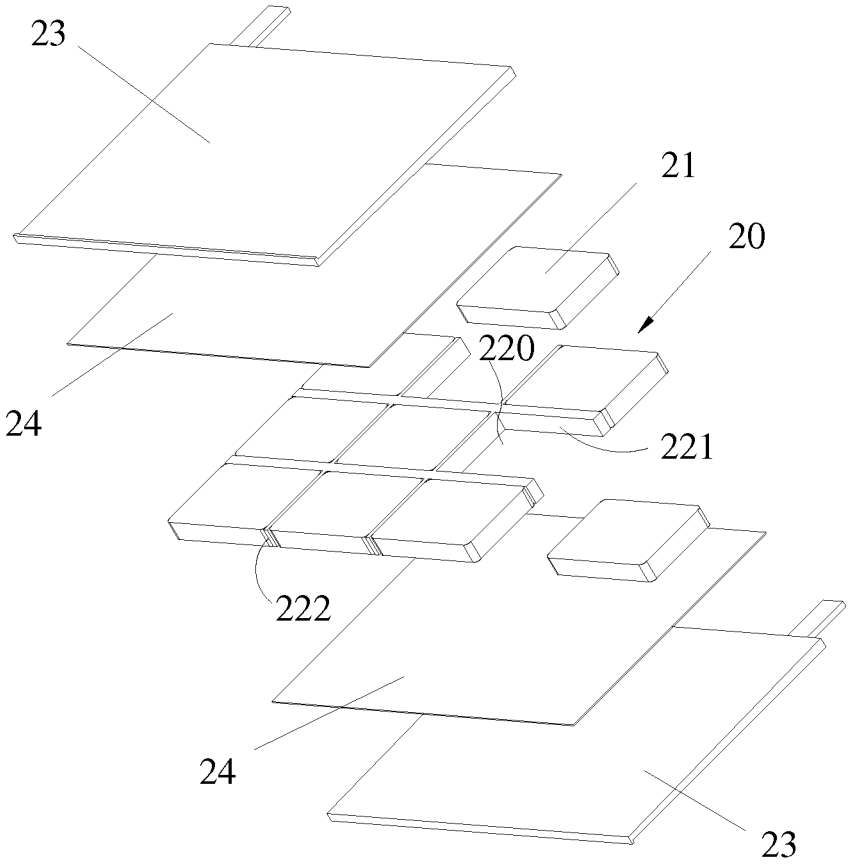
FIG. 5 is an exploded view of a PTC electric heating assembly according to an embodiment of the present disclosure.
Figure 6:
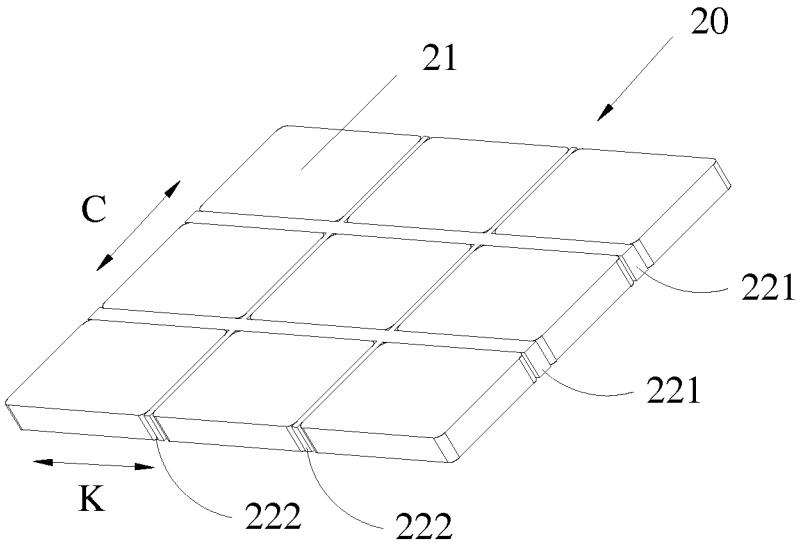
FIG. 6 is a schematic view of a PTC heating module of the PTC electric heating assembly according to an embodiment of the present disclosure.

As shown in FIGS. 2-7, the PTC heating element 21 of the PTC heating module 20 is the heating element of the PTC electric heating assembly 2. The PTC heating module 20 includes at least two PTC heating elements 21. In some embodiments, as shown in FIG. 6, the PTC heating module 20 includes nine PTC heating elements 21. However, the number of the PTC heating elements 21 is not limited and adjustable according to the heating requirements.

In some embodiments, the PTC heating elements 21 may be ceramic PTC heating pieces, and conductive electrodes (not shown) are disposed on opposite side surfaces of the ceramic PTC heating pieces by spraying or printing, and the conductive electrodes may be silver electrodes.

Figure 3:
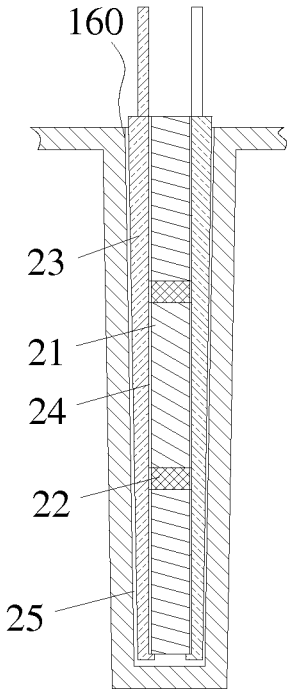
FIG. 3 is a sectional view showing that the PTC electric heating assembly is disposed in a thermal conducting groove of the PTC electric heating device according to an embodiment of the present disclosure.
Figure 7:
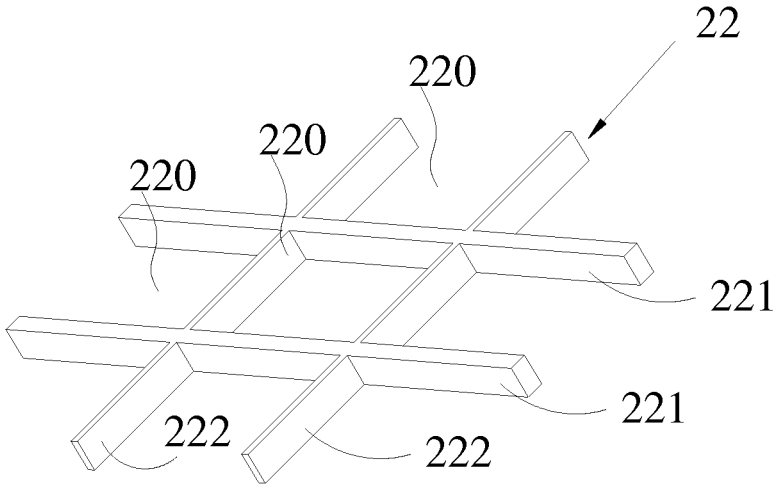
FIG. 7 is a schematic view of an insulation fixing frame of the PTC heating module in FIG. 6.

As shown in FIGS. 2-7, the heating module 20 comprises the insulation fixing frame 22 and the PTC heating elements 21 disposed in the insulation fixing frame 22. As shown in FIGS. 5-7, in some embodiments, the insulating fixing frame 22 comprises a plurality of first isolating bars 221 and a plurality of second isolating bars 222. The first isolating bars 221 are parallel to and spaced apart from one another, and the second isolating bars 222 are parallel to and spaced apart from one another. Each of the second isolating bars is perpendicular to and intersected with the plurality of the first isolating bars 221 so as to form a plurality of fixing units 220.

As shown in FIG. 7, in this embodiment, the insulation fixing frame 22 comprises two first isolating bars 221 and two second isolating bars 222. The two first isolating bars 221 are parallel to and spaced from each other by a first predetermined interval, and the two second isolating bars 222 are parallel to and spaced from each other by a second predetermined interval. Each of the first isolating bars 221 is perpendicular to and intersected with the two second isolating bars 222 so as to form nine fixing units 220 such as fixing grooves or fixing spaces, thus providing nine mounting positions for nine PTC heating elements 21. A person skilled in the art will appreciate that the number of the fixing units 220 can be determined by the number of the PTC heating elements 21, then the number of the first isolating bars 221 and the second isolating bars 222 are further determined. A person skilled in the art will appreciate that the insulation fixing frame 22 is not limited to the structure and configuration shown in FIG. 7.

As shown in FIGS. 6 and 7, the two first isolating bars 221 are disposed along a width direction K of the PTC heating elements 21, and a distance between the two first isolating bars 221 is equal to a length of the PTC heating elements 21 (a size of the PTC heating element 21 in a length direction C thereof), so that the PTC heating element 21 is positioned in the length direction C efficiently.

The two second isolating bars 222 are disposed along the length direction C of the PTC heating elements 21, and a distance between the two second isolating bars 222 is equal to a width of the PTC heating elements 21 (a size of the PTC heating element 21 in the width direction K thereof), so that the PTC heating element 21 is positioned in the width direction K efficiently.

Furthermore, as shown in FIG. 6, in the length direction C, the adjacent PTC heating elements 21 are spaced apart from each other by the first isolating bars 221, and in the width direction K, the adjacent PTC heating elements 21 are spaced apart from each other by the second isolating bars 222. The adjacent PTC heating elements 21 are spaced apart from each other by the first isolating bars 221 and/or the second isolating bars 222, thus reducing the mutual influence of the PTC heating elements 21 during the operation, so that the PTC heating elements 21 can be improved in heating power thereof and give full play to the heating performance thereof.

Figure 2:
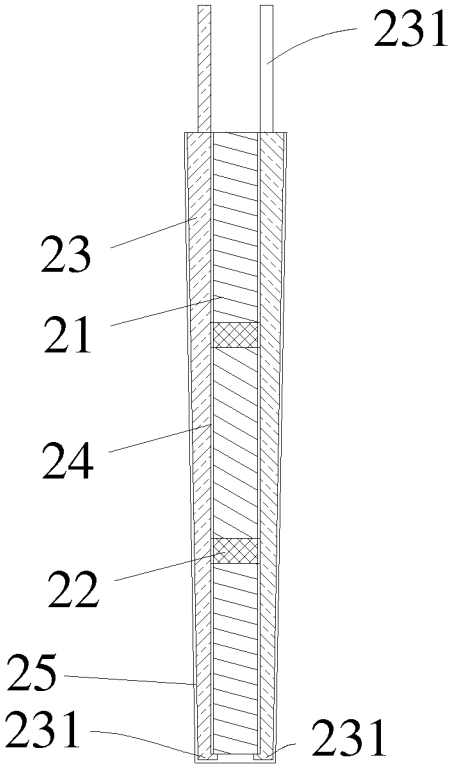
FIG. 2 is a sectional view of a PTC electric heating assembly according to an embodiment of the present disclosure.

As shown in FIG. 2 and FIG. 4, the insulation fixing frame 22 is disposed between the two electrode plates 23 and may be adhered to the two electrode plates 23 by an adhesive, so that a thickness of the insulation fixing frame 22 is substantially equal to that of the PTC heating elements 21, and a tolerance of −5% to 5% may be allowed.

In some embodiments, the thickness of the insulation fixing frame 22 is equal to that of the PTC heating elements 21, in other words, thicknesses of the first isolating bar 221 and/or the second isolating bar 222 are equal to that of the PTC heating elements 21, so that the insulation fixing frame 22 is fixed between the electrode plates 23 reliably, thus fixing the PTC heating elements 21 therein reliably, without affecting proper contacts between the PCT heating elements 21 and the electrode plates 23.

Thus, the PTC heating elements 21 are isolated and positioned in the length direction C and the width direction K by the insulation fixing frame 22, and are clamped and held between the two electrode plates 23 in the thickness direction (the up and down direction in FIG. 4 or the right and left direction in FIG. 2), so that the PTC heating elements 21 can be efficiently positioned.

Conventionally, a person skilled in the art will appreciate that, when the PTC electric heating assembly 2 is used under a high voltage condition, in order to avoid the arc discharge occurred between the two electrode plates 23 and meet the safe standard, the requirements for the distance between the two electrode plates 23 are strict. Consequently, the volume of the PTC electric heating assembly 2 is increased.

However, in some embodiments of the present disclosure, the insulation fixing frame 22 is made of a material having a high temperature resistance and a high voltage resistance, so that a high voltage resistance between the two electrode plates 23 is improved, a possibility of the arc discharge occurred between the two electrode plates 23 is reduced and the PTC heating elements 21 are prevented from being broken down.

In some examples, advantageously, the insulation fixing frame 22 having the high voltage resistance and high temperature resistance is made of an organic polymer, such as organic silicon or polyimide, with a thermal conductivity between 0.02 W/(m·K) and 5.0 W/(m·K). The insulation fixing frame 22 may be manufactured by a process of injection molding. With the insulation fixing frame 22, an insulating performance between the two electrode plates 23 is efficiently increased, so that the PTC electric heating assembly 2 can be adapted to a high voltage condition, and the safety and adaptability thereof are improved.

As shown in FIGS. 2 and 4, the electrode plates is made of a conductive material, such as aluminum, copper, stainless steel, aluminum alloy, copper alloy and nickel base alloy. A leading out terminal 231 for coupling to a power supply is fixed on an upper end of the insulation fixing frame 23 by a welding or riveting. In order to ensure the proper contact between the PTC heating module 20 and the electrode plate 23, the area of the side surface of the electrode plates 23 is larger than or equal to that of the PTC heating module 20. More advantageously, the area of the side surface of the electrode plate 23 is larger than that of the PTC heating module 20, so that the electrode plates 23 extend upwardly and/or downwardly beyond the PTC heating module 20 so as to form extending portions 231.

As shown in FIG. 2, the electrode plates 23 extend downwardly beyond the low edges of the PTC heating module 20 so as to form the extending portions 231 at the bottom ends of the electrode plates 23. A heat conducting sealing glue (not shown) such as polyimide may be filled between the extending portions 231 of the two electrode plates 23, so as to insulate the two electrode plates 23 and avoid a short circuit therebetween.

As shown in FIGS. 1-4, in some embodiments, the thicknesses of the two electrode plates 23 are decreased gradually along the up and down direction, in other words, both of the front surface (left surface in FIG. 4) and the rear surface (right surface) of each of the two electrode plates 23 are trapezia. The inner surface of each of the two electrode plates 23 facing to the insulation fixing frame 22 is a vertical surface, and the outer surface of each of the two electrode plates 23 away from the insulation fixing frame 22 is an inclined surface, in other words, the outer surface are inclined inwardly in the up and down direction.

A person skilled in the art will appreciate that the thickness of one electrode plate 23 may be decreased gradually along the up and down direction, and the thickness of the other electrode plate 23 may not be changed. The PTC electric heating assembly 2 can be easily mounted, positioned and disassembled, because the thickness of at least one electrode plate 23 is decreased gradually along the up and down direction, which will be described below.

As shown in FIG. 2, it is known that an electric conductivity between the PTC heating elements 21 and the electrode plates 23 as well as the value of the contact resistance has a great influence on the voltage resistance performance of the PTC heating module 20, especially on the safety and the reliability of the PTC heating module 20 under a long time and a high voltage operation condition. In the related art, the PTC heating elements and the electrode plates of the conventional electric heating assembly are contacted directly and rigidly, so that an interfacial gap is formed therebetween. Under the high voltage condition, this contacting manner can easily cause the PTC heating elements 21 broken down due to the arc discharge, thus resulting in the short circuit.

In embodiments of the present disclosure, a contact electrode 24 is disposed between the PTC heating module 20 and each of the electrode plates 23, and adhered to the insulation fixing frame 22 by an adhesive. More specifically, the contact electrode 24 is configured as a compressible conducting layer or an elastic sheet. The compressible conducting layer comprises polymer and a conducting material compounded with the polymer. By way of example and without limitation, the polymer in the compressible conducting layer comprises one or more selected from polyimide, PTFE, organic siliconresion and ethoxyline resin. By way of example and without limitation, the conducting material comprises one or more selected from metal fiber, metal particles, metal mesh, metal piece, carbon and graphite.

A plurality of contact points (not shown) may be formed on two side surfaces of the elastic sheet, the contact point on one side surface of the elastic sheet is contacted with the PTC heating elements 21, and the contact point on the other side surface of the elastic sheet is contacted with the electrode plate 23. Both the compressible conducting layer and the elastic sheet have elasticity so as to reduce the contact resistance and not affect the heat conduction at the interface, comparing with the conventional direct contact between the rigid PTC heating elements 21 and the electrode plates 23. Thus, the heat generated by the PTC heating elements 21 can be conducted to the electrode plates 23 fully, and the PTC heating elements 21 can be used safely for a long time under the high voltage condition.

As shown in FIG. 2 and FIG. 3, the PTC electric heating assembly 2 further comprises an insulating layer 25 disposed on the outer surface of each of the electrode plates 23, and the insulating layer 25 has a U-shape section so as to cover the outer surface and the bottom surface of the electrode plate 23, thus the electrode plates 23 are insulated from the thermal conducting grooves 160. The insulating layer 25 is an electrical-insulation and thermal conducting film and made of a material with an electrical insulatibity and a high thermal conductivity, so as to reduce the heat loss. For example, the insulating layer 25 may be made of a thermal conductive shim or a ceramic insulating material.

An electric heating device according to embodiments of the present disclosure will be described below with reference to the drawings.

As shown in FIGS. 1-10, the electric heating device comprises a casing 1 and a plurality of PTC electric heating assemblies 2 mounted in the casing 1. The PTC electric heating assemblies 2 may be the PTC electric heating assemblies described with reference to the above embodiments, so that detailed description thereof are omitted here.

More specifically, the casing 1 has a heating chamber 11 and a medium circulating cavity 12 therein. The heating chamber 11 has a plurality of thermal conducting grooves 160, in other words, the heating chamber 11 for heating the medium is formed by the thermal conducting grooves 160. The medium circulating cavity 12, for containing the medium and allowing the medium circulating therein, has a medium inlet 13 for feeding the medium into the medium circulating cavity 12 and a medium outlet 14 for discharging the medium out of the medium circulating cavity 12. The medium circulating cavity 12 and the heating chamber 11 (the thermal conducting grooves 160) are hermetically isolated. The PTC electric heating assemblies 2 are mounted into the thermal conducting grooves 160 in one to one correspondence relationship.

In order to facilitating manufacturing, mounting, positioning and disassembling of the PTC electric heating assemblies 2, and to improve the contact between the PTC electric heating assembly 2 and side surfaces of the thermal conducting grooves 160, as described above, the thicknesses of the electrode plates 23 is decreased gradually along the up and down direction, in other words, at least one side surface of the electrode plates 23 is inclined inwardly in the up and down direction.

Correspondingly, at least one side surface of the thermal conducting grooves 160 is inclined inwardly in the up and down direction so as to adapt to the inclined side surface of the electrode plate 23, in other words, the vertical section of the thermal conducting groove 160 is a trapezia. Thus, the PTC electric heating assemblies 2 may be embedded in the thermal conducting grooves 160 conveniently, and a desire contact between the PTC electric heating assemblies 2 and the thermal conducting grooves 160 may be formed by a press force applied to the PTC electric heating assemblies 2 by the side surface of the thermal conducting grooves 160 during mounting of the PTC electric heating assemblies 2. A person skilled in the art will appreciate that one side surface of each of the thermal conducting grooves 160 may be a vertical surface, and the other side surface thereof may be an inclined surface. Alternatively, both side surfaces of each of the thermal conducting grooves 160 may be the inclined surface.

As described above, the PTC electric heating assemblies 2 are embedded in the thermal conducting grooves 160 respectively, so that the heat generated by the PTC electric heating assemblies 2 may be conducted to the walls of thermal conducting grooves 160. In this case, the walls of thermal conducting grooves 160 not only isolate the medium from the PTC electric heating assemblies 2, but also conduct the heat. The walls of thermal conducting grooves 160 may be made of a metal having a good conducting performance, such as aluminum or aluminum alloy.

During manufacturing and assembling the PTC electric heating assemblies 2, firstly the insulation fixing frame 22 is disposed onto one electrode plate 23 (or the contact electrode 24), then the PCT heating elements 21 are disposed into the fixing units 220 of the insulation fixing frame 22 respectively. Next, the other electrode plate 23 (or the other contact electrode 24) is disposed on the side of the insulation fixing frame 22 away from the one electrode plate 23. The thermally conductive sealing glue is filled between edges the two electrode plates 23. Finally the insulating layer 25 is coated on the outer surfaces and the bottom surfaces of the two electrode plates 23 so as to form the PTC electric heating assemblies 2.

The assembled PTC electric heating assemblies 2 are embedded into the thermal conducting grooves 160 respectively. In use, the medium is fed into the medium circulating cavity 12 through the medium inlet 13 of the casing 1, then the PTC electric heating assemblies 2 are energized, the PTC heating elements 21 start heating. The heat is conducted to the medium via the electrode plates 23, insulating layer 25 and the walls of the thermal conducting grooves 160. The medium flows out of the medium circulating cavity 12 through the medium outlet 14 of the casing 1 for heating, defrosting and defogging the interior of a vehicle.

With the PTC electric heating assemblies 2 and electric heating device according to embodiments of the present disclosure, the PTC heating elements 21 are fixed into the fixing unit 220 of the insulation fixing frame 22 respectively, so that the PTC heating elements 21 are stably positioned and isolated from each other by the insulation fixing frame 22, thus reducing the interference among the PTC heating elements 21, giving full play to the heating performance, improving the heating power and heating effect, and providing a heating source used for heating, defrosting, and defogging the interior of the electric vehicle.

In addition, the insulation fixing frame 22 is made of a material having a high temperature resistance and a high voltage resistance, so that the insulation fixing frame 22 improves the voltage resistance between the two electrode plates 23, reduces the arc discharge and avoids the PTC heating elements 21 broken down due to the arc discharge. Thus, the PTC electric heating assemblies 2 and the electric heating device according to embodiments of the present disclosure are adapted to be used under the high voltage condition and have a high safety. Furthermore, the PTC heating module can be safely used in a high voltage system (such as the electric vehicle) for long time.

In some embodiments, as shown in FIG. 1 and FIGS. 8-10, a thermal conducting trough 164 is disposed in the casing 1, the thermal conducting grooves 160 are formed in the thermal conducting trough 164, and the medium circulating cavity 12 is defined between the thermal conducting trough 164 and an inner wall of the casing 1.

In some embodiments, the casing 1 comprises a first shell 15 and a second shell 16 mounted on the first shell 115. The thermal conducting trough 164 is disposed on the second shell 16 and extended into the first shell 15. Advantageously, the thermal conducting trough 164 may be formed integrally with the second shell 16. The medium circulating cavity 12 is defined between the thermal conducting trough 164 and an inner wall of the first shell 15, and the medium inlet 13 and the medium outlet 14 are disposed in the first shell 15.

Figure 8:
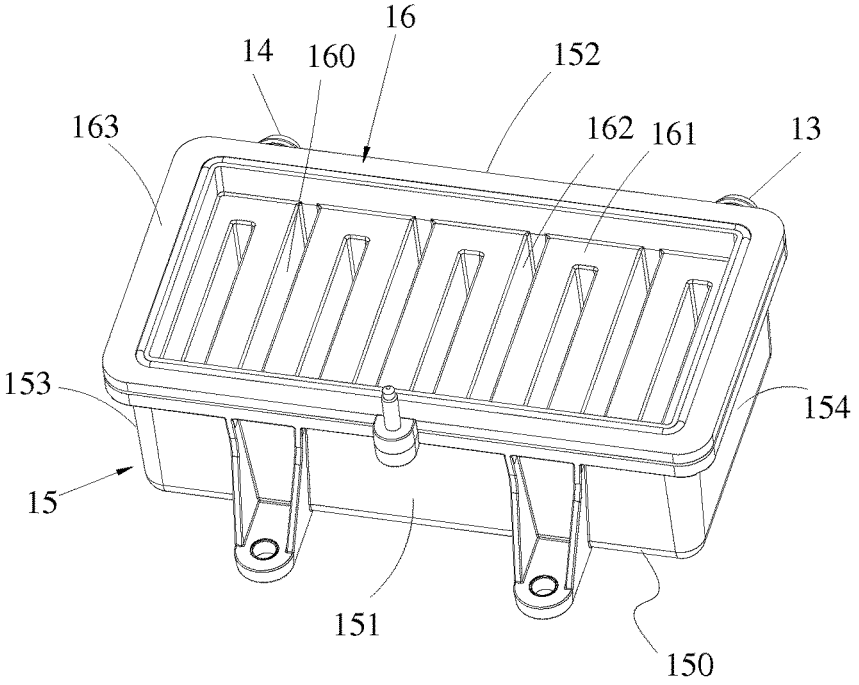
FIG. 8 is a schematic view of a casing of the electric heating device according to an embodiment of the present disclosure.
Figure 9:
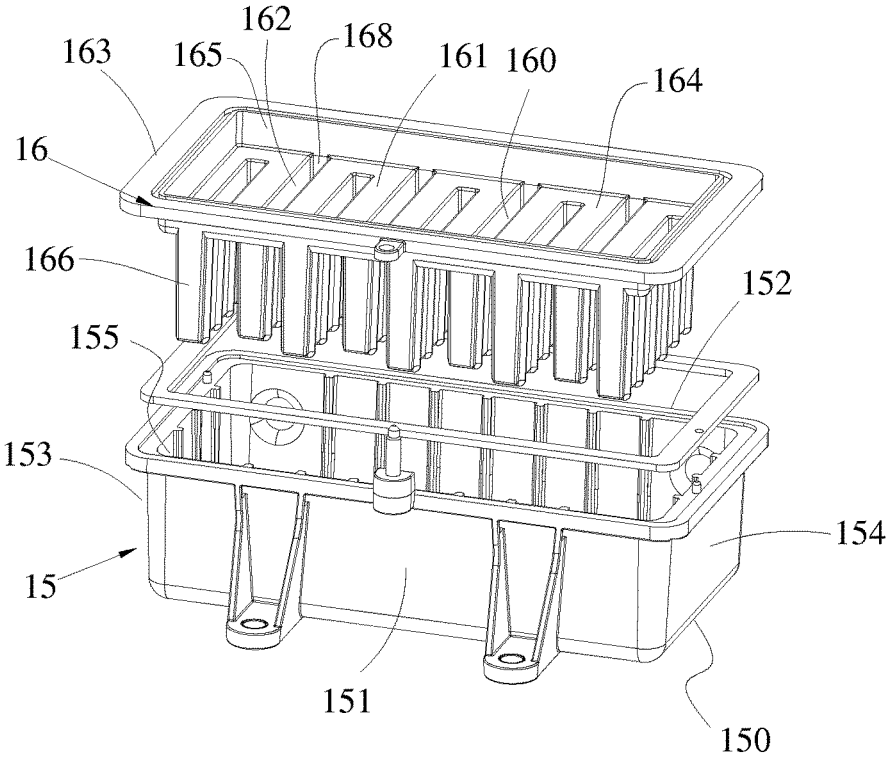
FIG. 9 is an exploded view of the casing of the electric heating device according to an embodiment of the present disclosure.
Figure 10:
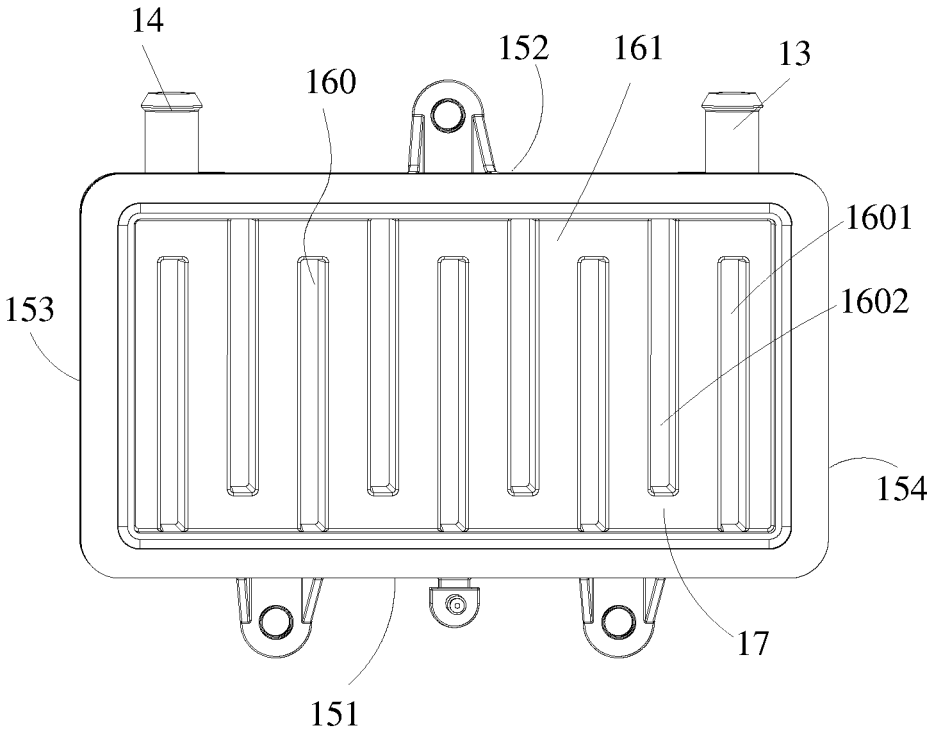
FIG. 10 is a top view of the casing of the electric heating device according to an embodiment of the present disclosure.

In a specific embodiment, as shown in FIGS. 8-10, the first shell 15 is a hollow rectangular parallelepiped and made of an insulating material. A top of the first shell 15 is open. The first shell 15 comprises a bottom plate 150 and four side plates so as to form a receiving chamber 155. The four side plates, such as a first side plate 151, a second side plate 152, a third side plate 153 and a fourth side plate 154, are extended upwardly from four edges of the bottom plate 150 along a substantially vertical direction.

The first side plate 151 and the second side plate 152 are disposed oppositely along a length direction of the first shell 1 (the right and left direction shown in FIGS. 1 and 10), and the third side plate 153 and the fourth side plate 154 are disposed oppositely along a width direction of the first shell 1 (the up and down direction shown in FIG. 10).

In order to increase flowing time and flowing distance of the medium, a distance between positions of the medium inlet 13 and the medium outlet 14 is as far as possible, for example, the medium inlet 13 and the medium 14 may be formed in two ends of the second side plate 152.

The second shell 16 comprises an annular plate 163 and a skirt portion 165 extended downwardly from a bottom surface of the annular plate 163, and the annular plate 163 is disposed on the top of the first shell 15. The thermal conducting trough 164 is connected to an inner circumferential edge of a low portion of the skirt portion 165 and extended into the receiving chamber 155. As shown in FIG. 1, the thermal conducting trough has a corrugated vertical section and comprises a corrugated top plate 161. Each of the thermal conducting grooves 160 is defined by two side isolating plates 162, a front plate 166, a rear plate 168 and a bottom plate 167.

An upper portion of each of side isolating plates 162, the front plate 166 and the rear plate 168 is connected to the top plate 161, a lower portion of each of the side isolating plates 162, the front plate 166 and the rear plate 168 is connected to the bottom plate 167. Adjacent side isolating plates 162 of the thermal conducting grooves 160 are opposite to each other and spaced apart from each other so as to form circulating grooves 120. As shown in FIG. 1, the circulating grooves 120 and the thermal conducting grooves 160 are arranged alternately along the right and left direction.

As described above, at least one side isolating plate 162 of the thermal conducting grooves 160 may be inclined. More advantageously, both side isolating plates 162 of each of the thermal conducting grooves 160 may be inclined, and lower portions of the two side isolating plate 162 of each of the thermal conducting grooves 160 are close to each other. Correspondingly, the thickness of the electrode plates 23 is decreased gradually along the up and down direction as well, in other words, the two side surfaces of the PTC electric heating assembly 2 are inclined surfaces.

The PTC electric heating assemblies 2 are adapted to the thermal conducting grooves 160 and mounted therein. Thus, the thermal conducting grooves 160 isolate the medium from the PTC electric heating assemblies 2 and conduct the heat. The thermal conducting trough 164 (i.e. walls of the thermal conducting grooves 160) may be made of a material having an excellent conducting performance, such as aluminum or aluminum alloy. Advantageously, the annular plate 163, the skirt portion 165, the top plate 161, the side plates 162, the front plate 166, the rear plate 168 and the bottom plate 167 are made of a material having an excellent conducting performance and formed integrally into one piece.

As shown in FIG. 1, the outermost circulating groove 120 is formed between the outermost thermal conducting groove 160 and the first shell 15, the remaining circulating grooves 120 are formed between the adjacent thermal conducting grooves 160. The thermal conducting grooves 160 are sealed relative to the circulating grooves 120, so as to prevent the medium from damaging the PTC electric heating assemblies 2.

In an embodiment, the circulating grooves 120 are communicated to each other. For example, a communicating channel 17 is formed by the walls of the thermal conducting grooves 160 and the first side wall 151 or the second side wall 152 of the first shell 15. The thermal conducting grooves 160 are communicated via the communicating channel 17, and the medium circulating cavity 12 defines a curved path. Thus, the medium is fed into the medium circulating cavity 12 via the medium inlet 13 and then passes through the medium circulating cavity 12 along the curved path, so that the passing path of the medium is lengthened, the heat absorbing time is increased and the heating absorbing efficiency is improved. Moreover, the medium flows around the thermal conducting grooves 160 so as to improve the heating absorbing efficiency.

As shown in FIG. 10, the plurality of thermal conducting grooves 160 are divided into a plurality of first thermal conducting grooves 1601 and a plurality of second thermal conducting grooves 1602, and the first thermal conducting grooves 1601 and the second thermal conducting grooves 1602 are arranged alternately.

The front plates 166 of the first thermal conducting grooves 1601 are extended to the first side wall 151, and the rear plates 168 are spaced from the second side wall 152. The rear plates 168 of the second thermal conducting grooves 1602 are extended to the second side wall 152, and the front plates 166 are spaced from the first side wall 151, so that the communicating channel 17 is formed.

The circulating grooves 120 are communicated to each other by the communicating channel 17 so as to define an S-shaped medium circulating cavity 12. The medium is fed into the medium circulating cavity 12 via the medium inlet 13, then passes through the S-shaped medium circulating cavity 12 along a circumferential and curved path, finally discharged from the medium outlet 14. Thus, the passing path between the medium inlet 13 and the medium outlet 14 is lengthened, so that the heat absorbing time is increased and the heating absorbing efficiency is improved.

Furthermore, the medium flows around the thermal conducting grooves 160 so as to efficiently absorb the heat generated by the PTC electric heating assemblies 2 embedded into the thermal conducting grooves 160, and a heat efficiency of the electric heating device is improved. In this embodiment, the number of the thermal conducting grooves 160 is nine, the number of the first thermal conducting grooves 1601 is five, and the number of second thermal conducting grooves 1602 is four. A person skilled in the art will appreciate that the number of the thermal conducting grooves 160, the first thermal conducting grooves 1601 and second thermal conducting grooves 1602 is adjustable according to requirements.

The assembling and usage of the PTC electric device according to embodiments of the present disclosure will be described below.

Firstly, the PTC electric heating assemblies 2 is embedded into the thermal conducting grooves 160 by a clamp, then the second shell 16 is mounted to the first shell 15 and the first shell 15 and the second shell 16 are sealed to form the medium circulating cavity 12.

In use, the medium is fed into the medium circulating cavity 12 through the medium inlet 13 of the first shell 15, when the PTC electric heating assemblies 2 are energized, the PTC heating elements 21 start heating, and the heat is conducted to the medium via the electrode plates 23, the insulating layer 25 and the thermal conducting grooves 160. The medium flows out of the medium circulating cavity 12 through the medium outlet 14 of the second shell 16 so as to carry the heat for heating, defrosting and defogging the interior of the vehicle.

An electric vehicle according to embodiments of the present disclosure comprises an air-conditioning and heating system including the electric heating device described with reference to the above embodiments, and a heating exchanger coupled to the electric heating device. The medium is heated during passing through the electric heating device and then flows into the heating exchanger, such that the heat is exchanged and released to be used for heating, defrosting, defogging.

Performance Test

1. Principle of the performance test: a rated voltage was applied to the electric heating device by a high voltage power supply and the electric heating device generates heat, and a real-time current was displayed, so that the medium (such as a circulating cooling fluid) circulated inside the electric heating device was heated by the heat. Then, when the circulating cooling fluid passed through the heat exchanger, the heat carried by the circulating cooling fluid was taken away by the wind generated by a fan, therefore, the temperature of the wind was increased, but the temperature of the circulating cooling fluid was dropped. Next, the circulating cooling fluid with dropped temperature was circulated back to the electric heating device by a circulating conduit. The temperatures of fluids (including the circulating cooling fluid and the wind) were collected by a data collecting system.

2. Test parameters: voltage: 400 VDC, a flow rate of the circulating cooling fluid: 10 L/min, a flow rate of the wind: 450 $m^3$/h (a voltage used in lab corresponding to the fan is 12 VDC), a system temperature: 23±5° C.

3. Test steps: 1) mounting the electric heating device for testing in a cooling fluid circulating system; 2) starting the data collecting system to collect the real-time temperatures of the fluids and the environment; 3) starting the fan and maintaining the flow rate of the wind at 450 $m^3$/h; 4) starting a pump and maintaining the flow rate of the circulating cooling fluid at 10 L/min; 5) maintaining the temperature of the circulating cooling fluid at a room temperature (23±5° C.) stably; 6) setting the voltage of the high voltage power supply at 400 VDC and supplying the power to the electric heating device after the temperature of the circulating cooling fluid is stable; 7) reading the real-time current of the high voltage power supply and recording an inrush current (i.e. the maximum current can be reached after the high voltage power supply is turned on for about 10 s); 8) when a fluctuation of the current is less than 0.05 A within 5 minutes, recording the stable current and stopping the test.

During the test of energizing and deenergizing, the voltage of the electric heating device was 600 VDC, the open and close of a high voltage circuitry was controlled by a power supply control unit, and the remaining parameters were not varied.

4. Test results: a sample of the PTC electric heating assembly A1 was prepared according to embodiments of the present disclosure (a structure of the sample A1 is shown in FIG. 2), a contrast sample of a conventional PTC electric heating assembly B1 was prepared. Both the sample A1 and the sample B1 were made of identical material and tested using the above test method under the above the test conditions. The only difference was that the sample B1 was not assembled with the insulation fixing frame 22. The test results were as shown in Table 1.

TABLE 1

| | Test | | |
|---|---|---|---|
| Testing items | Technical requirements | Test results of the sample B1 | Test results of the sample A1 |
| Imax/A | ≤20 | 17.2 | 17.1 |
| Istable/A | null | 10.9 | 11.7 |
| P/w | 4000 ± 5° C. | 4360 | 4680 |
| energizing and deenergizing test 10,000 times | 600 V, energizing 1 min, deenergizing 1 min | The sample is broken down after energizing and deenergizing 196 times | No broken down occurred |

It can be seen from the results of the Table 1 that, the sample A1 had a higher power than the sample B1, was not broken down and has no short circuit during energizing and deenergizing test. Thus, the PTC electric heating assembly A1 according to embodiments of the present disclosure may improve the heating power of the PTC heating elements efficiently, have an excellent safety and be adapted to the high voltage condition by isolating and fixing the PTC heating elements via the insulation fixing frame.

The electric heating device according to embodiments of the present disclosure has the following advantages:

1. The fixing units are formed in the electric heating assembly by the insulation fixing frame, and the PTC heating elements are fixed in the fixing units in one to one correspondence relationship so as to ensure the stability of the PTC heating elements. Furthermore, the PTC heating elements are also isolated from one another by means of the insulation fixing frame, so that the interference among the PTC heating elements can be reduced during operation, give full play to the heating performance thereof, and improve the heating power and the heating effect thereof. Correspondingly, the heating power and the heating efficiency of the electric heating device are improved efficiently, and the heating device can provide heat for heating, defrosting, and defogging of the electric vehicle.

2. The insulation fixing frame is made of the material having a high temperature resistance and a high voltage resistance, and the high voltage resistance between the two electrode plates is improved, thus reducing the arc discharge between the two electrode plates and preventing the PTC heating elements from being broken down due to the arc discharge. Thus, the PTC electric heating assemblies are suitable for the high voltage condition and have an excellent safety, and the PTC heating module can be used safely in the high voltage system (the electric vehicle) for long time.

3. The vertical section of the two electrode plates and the thermal conducting grooves are trapezia, so that the PTC electric heating elements are adapted to the thermal conducting grooves and can be embedded fixedly into the thermal conducting grooves without additional fixing elements. The heat generated by the PTC electric heating elements can be conducted directly to the medium in the medium circulating cavity by the walls of thermal conducting grooves, so that the heat loss is reduced and the heat efficiency of the electric heating device having the PTC electric heating elements is efficiently improved.

4. In the electric heating device according to embodiments of the present disclosure, the medium circulating cavity comprises a plurality of the circulating grooves which are communicated to each other by the communicating channel, so that the medium circulating cavity having a curved form (for example, S-shaped medium circulating cavity) is configured. The medium passes through the medium circulating cavity along a curved path, so that the passing path of the medium and the time for absorbing heat are increased. Moreover, the medium flows around the walls of thermal conducting grooves so as to increase the contact area and improve the heating absorbing efficiency, and the heat efficiency of the electric heating device is further improved.

Reference throughout this specification to "an embodiment," "some embodiments," "one embodiment", "another example," "an example," "a specific examples," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example, "in an example," "in a specific examples," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. A PTC electric heating assembly comprising:

two electrode plates;

a PTC heating module disposed between the two electrode plates; and a contact electrode disposed between the PTC heating module and each of the electrode plates, wherein the PTC heating module includes:

an insulation fixing frame defining a plurality of spaces; and a plurality of PTC heating elements disposed in the spaces respectively.

2. The PTC electric heating assembly of claim 1, wherein the insulation fixing frame comprises:

a plurality of first isolating bars parallel to and spaced apart from one another; and a plurality of second isolating bars parallel to and spaced apart from one another, each of the plurality of second isolating bars being perpendicular to and intersected with the plurality of first isolating bars so as to form the plurality of spaces.

3. The PTC electric heating assembly of claim 2, wherein the plurality of first isolating bars are parallel to a width direction of the PTC heating elements so that an interval between adjacent first isolating bars is equal to a length of the PTC heating element, wherein the plurality of second isolating bars are parallel to a length direction of the PTC heating elements so that an interval between adjacent second isolating bars is equal to a width of the PTC heating element.

4. The PTC electric heating assembly of claim 2, wherein a thickness of the first isolating bars and/or the second isolating bars is equal to that of the PTC heating elements.

5. The PTC electric heating assembly of claim 1, wherein the insulation fixing frame is made of an organic polymer having a thermal conductivity between 0.02 W/(m·K) and 5.0 W/(m·K).

6. The PTC electric heating assembly of claim 1, wherein the insulation fixing frame is made of silicone or polyimide by injection molding, wherein the PTC heating elements is made of a ceramic.

7. The PTC electric heating assembly of claim 1, wherein at least one of the two electrode plates has a cross-section with a rectangular-trapezoid shape, and a thickness of the at least one of the two electrode plates decreases along an up-to-down direction.

8. The PTC electric heating assembly of claim 1, wherein an area of any one of the inner surface and the outer surface of the electrode plate is larger than that of a side surface of the heating module opposing the electrode plate so that an extending portion of the electrode plate extends beyond the PTC heating module, and a thermally conductive sealing glue is filled between the extending portions of the two electrode plates, wherein the PTC electric heating assembly further comprises an insulating layer coated on the outer surface and bottom surface of each of the two electrode plates.

9. An electric heating device comprising:

a casing defining a plurality of thermal conducting grooves and a medium circulating cavity hermetically isolated from the thermal conducting grooves, the medium circulating cavity defining a medium inlet and a medium outlet; and a plurality of PTC electric heating assemblies mounted into the thermal conducting grooves respectively, each PTC electric heating assembly including:

two electrode plates;

a PTC heating module disposed between the two electrode plates; and a contact electrode disposed between the PTC heating module and each of the electrode plates, wherein the PTC heating module includes:

an insulation fixing frame defining a plurality of spaces; and a plurality of PTC heating elements disposed in the spaces respectively.

10. The electric heating device of claim 9, wherein at least one side surface of the thermal conducting groove has a cross-section with a rectangular-trapezoid shape in an up and down direction, and the side surfaces of the thermal conducting groove are adapted to those of the electrode plate respectively.

11. The electric heating device of claim 9, wherein a thermal conducting trough is disposed in the casing, the thermal conducting grooves are formed in the thermal conducting trough, and the medium circulating cavity is defined between the thermal conducting trough and an inner wall of the casing.

12. The electric heating device of claim 11, wherein the casing comprises:

a first shell; and a second shell mounted onto the first shell, wherein the thermal conducting trough is disposed on the second shell and extended into the first shell, the medium circulating cavity is defined between the thermal conducting trough and an inner wall of the first shell, and the medium inlet and the medium outlet are formed in the first shell.

13. The electric heating device of claim 12, wherein the first shell is a rectangular parallelepiped and a top of the first shell is open, wherein the second shell includes an annular plate and a skirt portion extended downwardly from a bottom surface of the annular plate, the annular plate is disposed on the top of the first shell, wherein the thermal conducting trough has a corrugated vertical section and comprises a corrugated top plate, each of the thermal conducting grooves is defined by two side isolating plates, a front plate, a real plate and a bottom plate, wherein an upper portion of each of the side isolating plates, the front plate and the rear plate is connected to the top plate, and a lower portion of each of the side isolating plates, the front plate and the rear plate is connected to the bottom plate, wherein adjacent side isolating plates are spaced apart from each other.

14. An electric vehicle comprising:

an air conditioning system employing an electric heating device, the electric heating device including:

a casing defining a plurality of thermal conducting grooves and a medium circulating cavity hermetically isolated from the thermal conducting grooves, the medium circulating cavity defining a medium inlet and a medium outlet; and a plurality of PTC electric heating assemblies mounted into the thermal conducting grooves respectively, each PTC electric heating assembly including:

two electrode plates;

a PTC heating module disposed between the two electrode plates; and a contact electrode disposed between the PTC heating module and each of the electrode plates, wherein the PTC heating module includes:

an insulation fixing frame defining a plurality of spaces; and a plurality of PTC heating elements disposed in the spaces respectively.

* * * * *